US005216189A

United States Patent [19]

Kato

[11] Patent Number: 5,216,189

[45] Date of Patent: Jun. 1, 1993

[54] ELECTRONIC MUSICAL INSTRUMENT HAVING SLUR EFFECT

[75] Inventor: Mitsumi Kato, Hamamatsu, Japan

[73] Assignee: Yamaha Corporation, Hamamatsu, Japan

[21] Appl. No.: 443,660

[22] Filed: Nov. 29, 1989

[30] Foreign Application Priority Data

| | | | |
|---|---|---|---|
| Nov. 30, 1988 | [JP] | Japan | 63-303547 |
| Nov. 30, 1988 | [JP] | Japan | 63-303548 |
| Nov. 30, 1988 | [JP] | Japan | 63-303549 |
| Nov. 30, 1988 | [JP] | Japan | 63-303550 |
| Dec. 19, 1988 | [JP] | Japan | 63-319741 |
| Dec. 20, 1988 | [JP] | Japan | 63-321771 |

[51] Int. Cl.[5] ..... G10H 5/00; G10H 1/02

[52] U.S. Cl. ..... 84/662; 84/626; 84/628

[58] Field of Search ..... 84/626, 662, 628, 701, 84/704

[56] References Cited

U.S. PATENT DOCUMENTS

| | | | |
|---|---|---|---|
| Re. 32,838 | 1/1989 | Suzuki | 84/628 |
| 3,929,053 | 12/1975 | Deutsch | 84/628 |
| 4,524,668 | 6/1985 | Tomisawa et al. | 84/1.24 |
| 4,558,624 | 12/1985 | Tomisawa et al. | 84/626 |
| 4,699,037 | 10/1987 | Minamitaka et al. | 84/658 |
| 4,726,276 | 2/1988 | Katoh et al. | 84/628 |
| 4,920,851 | 5/1990 | Abe | 84/626 |

*Primary Examiner*—William M. Shoop, Jr.
*Assistant Examiner*—Jeffrey W. Donels
*Attorney, Agent, or Firm*—Graham & James

[57] ABSTRACT

An electronic musical instrument effects the slur on several continuous notes when the slur is selected. The slur performance is detected based on performance information which is generated when performing the keyboard. Then, states of musical tones to be generated are varied from the first note to the last note in the slurred notes in accordance with a line or a curve corresponding to the predetermined musical factor to be detected. Preferably, this musical factor may be the tone color, key-depression intensity, pitch difference between the first note and last note in the slurred notes. Further, it is possible to select desirable one of the preset lines or curves whose data are stored in a memory.

11 Claims, 15 Drawing Sheets

22

| | NC=0 | NC=1 | | NC=ℓ |
|---|---|---|---|---|
| TD=0 | 1 | 8 | | |
| 1 | 2 | 8 | | |
| 2 | 2 | 9 | | |
| 3 | 3 | 9 | | |
| | ⋮ | ⋮ | - - - - - - | ⋮ |
| 63 | 7 | 15 | | |

FIG. 7

23

| | | |
|---|---|---|
| 1 | HEAD ADDRESS | SDN |
| 2 | HEAD ADDRESS | SDN |
| 3 | | |
| 4 | | |
| | ⋮ | ⋮ |
| n | | |

FIG. 8

ELECTRONIC MUSICAL INSTRUMENT HAVING SLUR EFFECT

BACKGROUND OF THE INVENTION

1. Field of the Invention

The present invention relates to an electronic musical instrument, and more particularly to an electronic musical instrument capable of applying a musical effect such as the slur, portamento, etc. to a musical tone.

2. Prior Art

The "slur" is one of the performance methods, by which the current note changes to the next note in such a manner that its tone pitch is smoothly varied. Therefore, when the slur is effected, the current tone pitch is not directly changed to the next tone pitch.

Recently, several kinds of electronic musical instruments have been developed in such a way that the above-mentioned slur can be automatically applied to the musical tone (see Japanese Patent Publication No. 63-4191, corresponding to U.S. Pat. No. 4,524,668). Such electronic musical instrument provides a slur switch. When a ligature performance operation (i.e., a key operation in which the second key is to be depressed before the depressing first key is released) is carried out in the state where the slur switch is on, the conventional electronic musical instrument automatically effects the slur, by which the first note (corresponding to the first key) smoothly changes to the second note (corresponding to the second key) in such a manner that the interval is smoothly varied.

In the typical electronic musical instrument, the slur is effected in such a manner that the interval is varied linearly. On the other hand, some electronic musical instruments can vary the interval along an exponentially curved line. This curved line is called as the slur curve along which the interval, tone volume, etc. are smoothly varied. However, the number of slur curves should be limited to only one in the conventional electronic musical instrument. In other words, there is a problem in that the conventional electronic musical instrument cannot vary the interval and the like along the free curve.

In addition, when the slur is effected, the tone volumes of the slurred notes are varied in such a manner that the first tone volume (corresponding to the key-depression intensity of the first note in the slurred notes) is linearly varied to the second tone volume (corresponding to the key-depression intensity of the last note in the slurred notes), which makes the conventional slur effect monotonous.

Further, when the slur is effected, tone pitches are sequentially varied in the slurred notes. However, the musical tone waveform itself is not varied. As a result, it seems that the similar notes having the similar waveforms are sequentially sounded by merely varying their tone pitches in the conventional electronic musical instrument.

SUMMARY OF THE INVENTION

It is accordingly a primary object of the present invention to provide an electronic musical instrument capable of varying the slur curve in response to the predetermined factor of the musical tone such as the tone color.

It is another object of the present invention to provide an electronic musical instrument in which the musical tone waveform can be varied in accordance with the variation of the tone pitch.

In a first aspect of the present invention, there is provided an electronic musical instrument comprising:

(a) generating means for generating performance information;

(b) slur detecting means for detecting a slur performance based on the performance information; and (c) varying means for sequentially varying musical tone states from a first note to a last note in slurred notes in accordance with a line or a curve which is set in response to a predetermined musical factor when the slur performance is detected by the slur detecting means.

In a second aspect of the present invention, there is provided an electronic musical instrument comprising:

(a) generating means for generating performance information;

(b) slur detecting means for detecting a slur performance based on the performance information;

(c) tone color detecting means for detecting a tone color selected by tone color selecting means; and (d) varying means for sequentially varying musical tone states from a first note to a last note in slurred notes in accordance with a line or a curve which is set in response to the tone color detected by the tone color detecting means when the slur performance is detected by the slur detecting means.

In a third aspect of the present invention, there is provided an electronic musical instrument comprising:

(a) generating means for generating performance information;

(b) slur detecting means for detecting a slur performance based on the performance information;

(c) memory means for storing data which varies in accordance with a predetermined curve; and (d) varying means for sequentially varying tone pitches from a first note to a last note in slurred notes in accordance with the curve indicated by the data which are sequentially read from the memory means when the slur performance is detected by the slur detecting means.

In a fourth aspect of the present invention, there is provided an electronic musical instrument comprising:

(a) a keyboard;

(b) slur detecting means for detecting a slur performance when the slur performance is carried out by use of the keyboard;

(c) detecting means for detecting a key-depression intensity of a depressed key in the keyboard; and (d) varying means for sequentially varying musical tone states from a first note to a last note in slurred notes in accordance with a line or a curve which is set in response to the key-depression intensity detected by the detecting means when the slur detecting means detects the slur performance.

In a fifth aspect of the present invention, there is provided an electronic musical instrument comprising:

(a) generating means for generating performance information;

(b) slur detecting means for detecting a slur performance based on the performance information;

(c) pitch difference detecting means for detecting a pitch difference between a first note and a last note in slurred notes when the slur detecting means detects the slur performance; and (d) varying means for sequentially varying musical tone states from the first note to the last note in the slurred notes in accordance with a line or a curve corresponding to the pitch difference detected by the pitch difference detecting means when the slur detecting means detects the slur performance.

In a sixth aspect of the present invention, there is provided an electronic musical instrument comprising:

(a) generating means for generating performance information;

(b) slur detecting means for detecting a slur performance based on the performance information;

(c) pitch difference detecting means for detecting a pitch difference between a first note and a last note in slurred notes when the slur detecting means detects the slur performance;

(d) memory means for storing plural sets of data indicating a plurality of lines or curves; and (e) varying means for reading out the data indicative of the line or curve corresponding to the pitch difference detected by the pitch difference detecting means from the memory means when the slur detecting means detects the slur performance, so that the varies means sequentially varying musical tone states from the first note to the last note in the slurred notes in accordance with the line or curve corresponding to read data.

In a seventh aspect of the present invention, there is provided an electronic musical instrument comprising:

(a) generating means for generating performance information;

(b) slur detecting means for detecting a slur performance based on the performance information;

(c) pitch control means for controlling pitches of slurred notes such that the pitches are smoothly varied from a first note to a last note in the slurred notes when the slur detecting means detects the slur performance; and (d) tone volume control means for sequentially varying tone volumes from the first note to the last note in the slurred notes in accordance with desirable one of predetermined lines or curves which is selected when the slur detecting means detects the slur performance.

In an eighth aspect of the present invention, there is provided an electronic musical instrument comprising:

(a) pitch varying means for sequentially varying pitches of musical tones to be generated; and (b) waveform varying means for sequentially varying musical tone waveforms of the musical tones in response to variations of the pitches.

In a ninth aspect of the present invention, there is provided an electronic musical instrument comprising:

(a) generating means for generating performance information;

(b) slur detecting means for detecting a slur performance based on the performance information and generating a slur start signal indicative of a start timing of a slur operation;

(c) memory means for storing data indicative of a line or a curve by which a musical tone is to be varied when the slur operation is carried out; and (d) varying means for continuously varying musical tone states from a first note to a last note in slurred notes in accordance with the line or curve when the slur start signal is generated so that the slur operation is carried out.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 7, 8 respectively show contents of a waveform number table and a head address table provided in a readout control circuit shown in FIG. 3;

DESCRIPTION OF A PREFERRED EMBODIMENT

Figure 1:
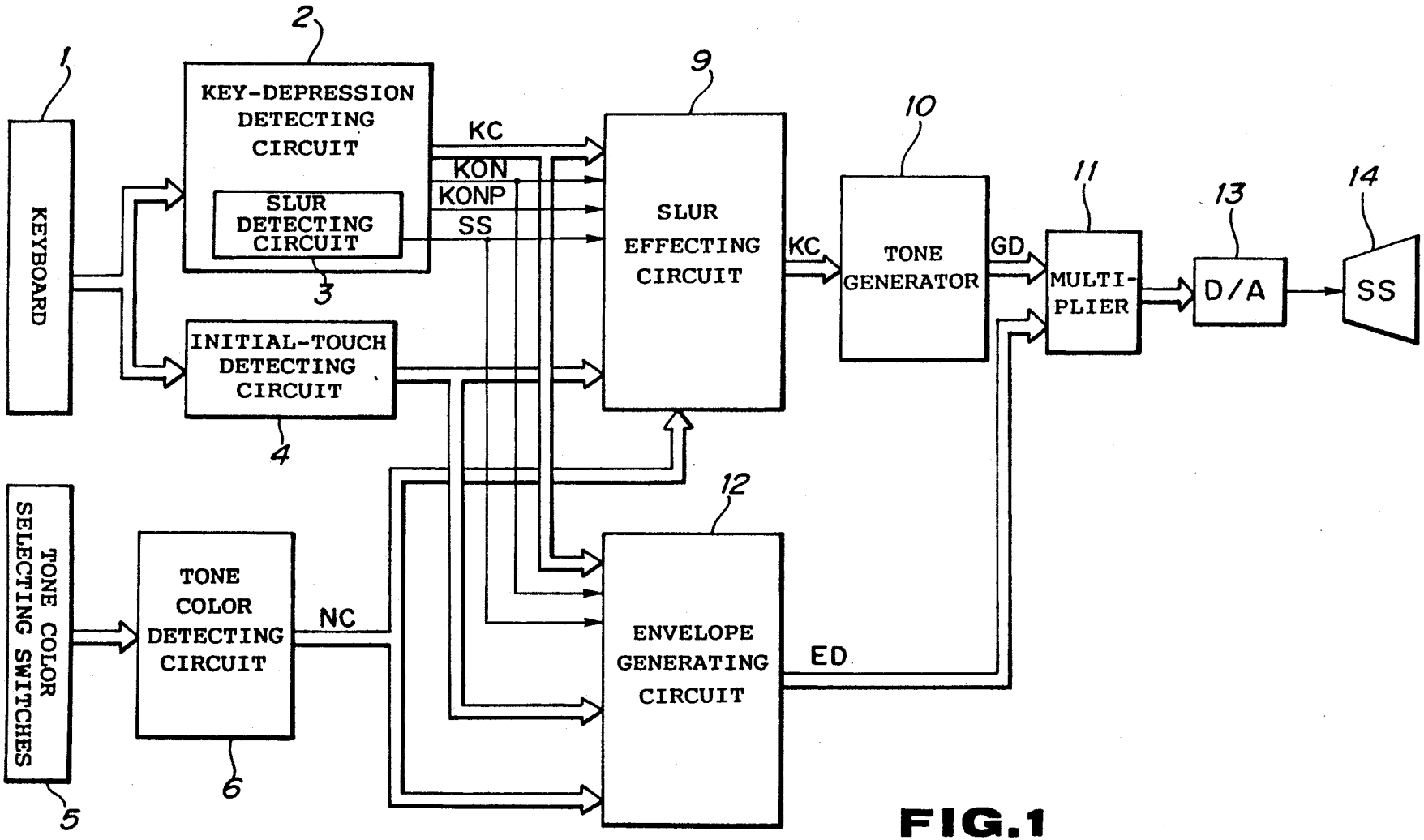
FIG. 1 is a block diagram showing a configuration of an electronic musical instrument according to an embodiment of the present invention.

Next, description will be given with respect to a preferred embodiment of the present invention by referring to the drawings.

[A] DIAGRAMMATICAL DESCRIPTION OF WHOLE CONFIGURATION

FIG. 1 is a block diagram showing the whole configuration of the electronic musical instrument according to an embodiment of the present invention. In FIG. 1, 1 designates a keyboard having plural keys. In order to detect the key operation, each key is provided with first and second key switches below it. Herein, the first key switch is turned on when the key is slightly depressed down, while the second key switch is turned on when the depressed position of the key reaches its lower limit position. In addition, 2 designates a key-depression detecting circuit which sequentially scans the outputs of the key switches to thereby detect the on/off states of the keys by every predetermined time. When the depressed key is detected, the key-depression detecting circuit 2 raises a key-on signal KON at "1" and outputs a key-on pulse KONP having a small pulse width. In addition, this circuit 2 also outputs a key code KC indicative of the detected key. Then, when it is detected that the depressed key is released, the key-depression detecting circuit 2 returns the level of the key-on signal KON to "0". In order to detect the specific key depressing operation for effecting the slur (hereinafter, simply referred to as the slur operation), a slur detecting circuit 3 is built in the key-depression detecting circuit 2. When this slur detecting circuit 3 detects the slur operation, it outputs a slur start signal SS (i.e., a pulse signal).

Next, an initial-touch detecting circuit 4 is the circuit which detects the initial key-depression intensity (i.e., initial-touch) of the depressed key. This initial-touch detecting circuit 4 measures the period between the first time when the first key switch is on and the second time when the second key switch is on. Then, this initial-touch detecting circuit 4 outputs touch data TD corresponding to the measured period.

Next, 5 designates tone color selecting switches for selecting the tone color, which are provided at an operation panel (not shown). 6 designates a tone color detecting circuit which scans the outputs of the tone color selecting switches 5 to thereby detect the current tone color by every predetermined time. Then, this circuit 6 outputs a tone color code NC indicative of the detected tone color. 9 designates a slur effecting circuit which effects the slur on the musical tone to be generated. When the slur start signal SS is supplied, this slur effecting circuit 9 outputs key codes KC which sequentially vary in the order from the first note (hereinafter, referred to as the first slur note) to the last note (hereinafter, referred to as the last slur note) in the slurred notes. On the other hand, in the case where the slur start signal SS is not supplied, the slur effecting circuit 9 directly passes and outputs the key code KC from the key-depression detecting circuit 2. A tone generator 10 generates digital musical tone data GD having the pitch indicated by the key code KC from the slur effecting circuit 9 and the tone color indicated by the tone color code NC from the tone color detecting circuit 6. Then, this musical tone data GD is fed to a multiplier 11. An envelope generating circuit 12 generates digital envelope data ED whose envelope is successively varied by the waveform which is synchronized with the key-on signal KON and which depends on the tone color code NC. Then, this envelope data ED is fed to the multiplier 11. The multiplier 11 multiplies the data GD with the data ED to thereby obtain its multiplication result, which is then outputted to a digital-to-analog (D/A) converter 13. The D/A converter 13 converts the digital output of the multiplier 11 into an analog musical tone signal, which is then outputted to a sound system 14. This sound system 14 is configured by an amplifier, a speaker, etc. Thus, the sound system 14 generates the musical tone corresponding to the analog musical tone signal outputted from the D/A converter 13.

[B] DESCRIPTION OF EACH PORTION IN ELECTRONIC MUSICAL INSTRUMENT

Next, description will be given with respect to each portion in the present electronic musical instrument.

(1) SLUR DETECTING CIRCUIT 3

Figure 2:
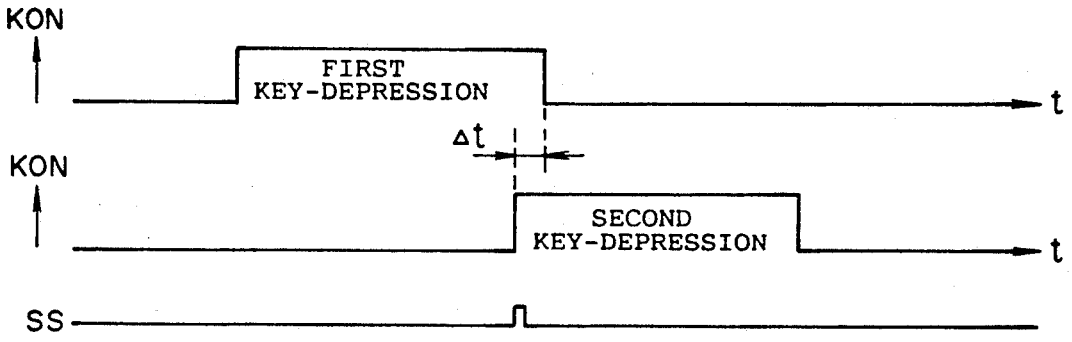
FIG. 2 is a timing chart for explaining the slur detection.

The present electronic musical instrument detects the slur operation in the case where the second key is depressed before the depressing first key is released as shown in FIG. 2 (i.e., in case of $\Delta t > 0$), so that it outputs the slur start signal SS.

Only in case of $0 \leqq \Delta t \leqq Tx$ (where Tx denotes the predetermined time), wherein the first key-depression period partially overlaps with the second key-depression period, the present electronic musical instrument can detect the slur operation.

In addition, it is possible to provide a slur designation switch. In this case, when this slur designation switch is operated, the electronic musical instrument searches out the tone whose envelope level is not at "0" at a first key-on timing after the slur designation switch is operated. When such tone is detected, the slur start signal SS is outputted. In this case, the slur is effected on the detected tone and next key-on tone.

(2) ENVELOPE GENERATING CIRCUIT 12

Figure 3:
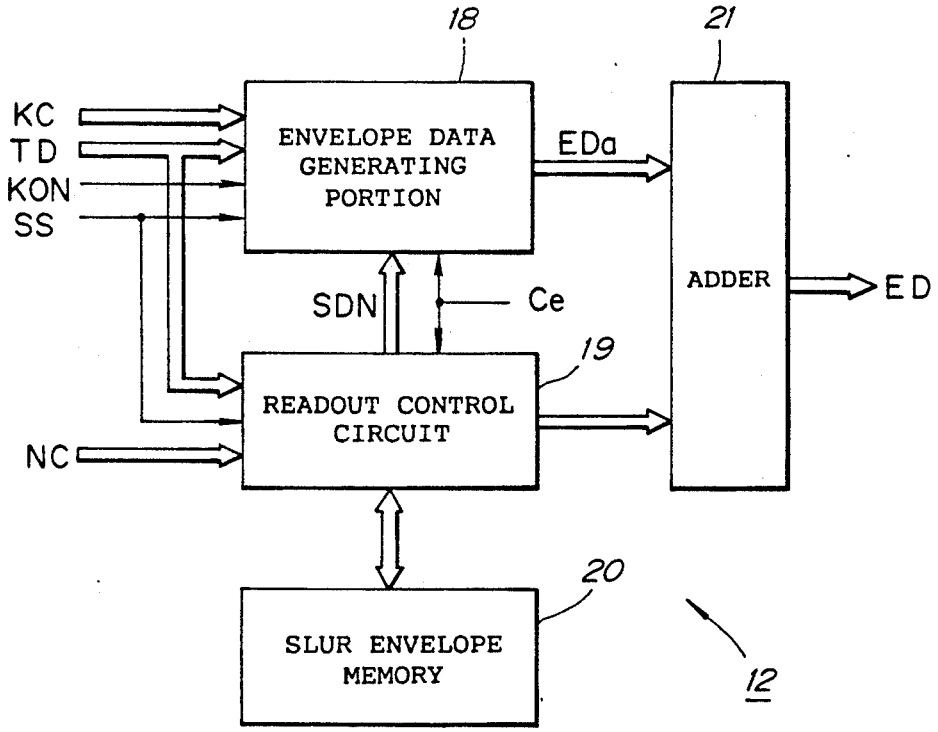
FIG. 3 is a block diagram showing the configuration of the envelope generating circuit shown in FIG. 1.
Figure 4:
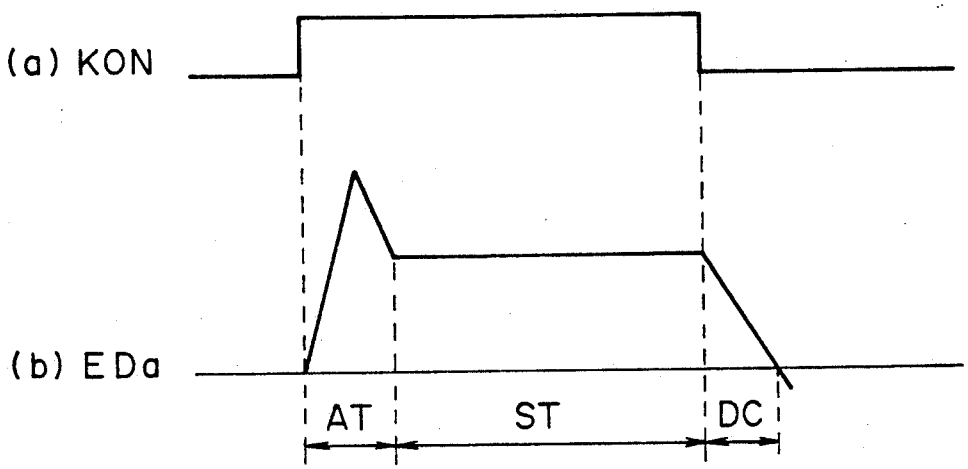
FIG. 4 shows waveforms for explaining envelope data EDa.

FIG. 3 is a block diagram showing the detailed configuration of the envelope generating circuit 12, wherein 18 designates an envelope data generating portion. This envelope data generating portion 18 receives the key-on signal KON (see FIG. 4(*a*) from the key-depression detecting circuit 2 to thereby generate envelope data EDa which varies by the envelope waveform shown in FIG. 4(*b*). This envelope data EDa is outputted by the timing of clock pulse Ce. This envelope waveform consists of a rising portion (or attack portion) AT, a constant portion ST and a declining portion (or decay portion) DC. This envelope waveform differs by every tone color. In addition, the peak values of the attack portion AT and constant portion ST depend on the touch data TD.

Figure 5:
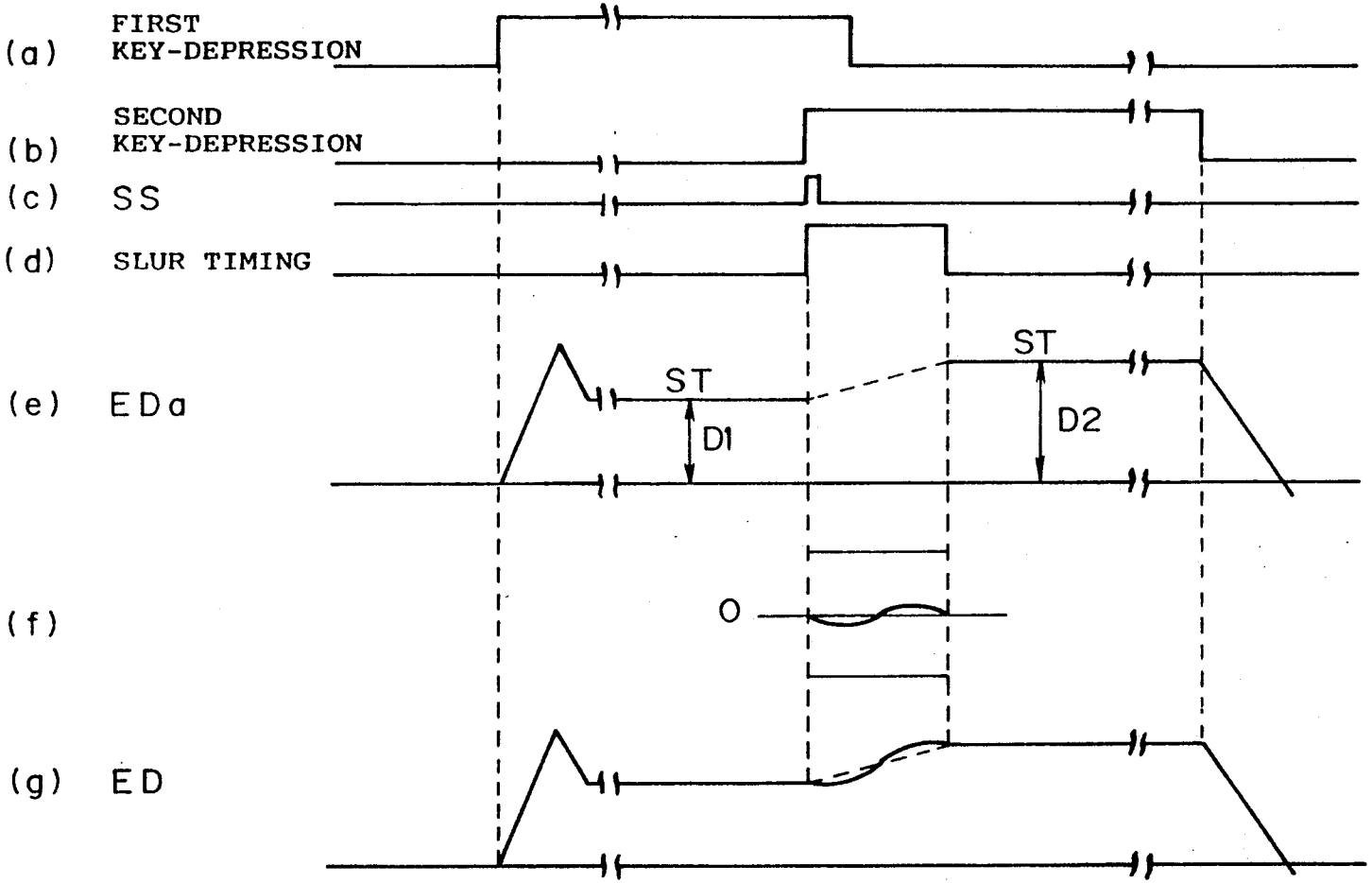
FIG. 5 is a timing chart for explaining the operations of the envelope generating circuit shown in FIG. 3.

When the above-mentioned envelope data generating circuit 18 receives the slur start signal SS, it generates another envelope data EDa which varies by another envelope waveform, wherein the first envelope waveform based on the first key-depression is linearly connected to the second envelope waveform based on the second key-depression. Such envelope data EDa is also outputted by the timing of clock pulse Ce. More specifically, in the case where the first and second key-depressions are as shown in FIGS. 5(*a*), 5(*b*) respectively, the slur start signal SS is generated just after the second key-depression timing as shown in FIG. 5(*c*). Then, the slur timing at which the slur is effected occurs as shown in FIG. 5(*d*). Thus, the envelope waveform indicated by the envelope data EDa is as shown in FIG. 5(*e*). It is apparent from FIG. 5(*e*), when the slur start signal SS is supplied to the envelope data generating portion 18, the first constant portion in the first envelope waveform corresponding to the first key-depression is linearly connected to the second constant portion in the second envelope waveform corresponding to the second key-depression. In the case where the number of envelope data is indicated by SDN, first and second constant portions are respectively indicated by D1, D2 at the slur timing and the following formula (1) can be given.

$$(D2-D1)/SDN=d \quad (1)$$

Thus, after the slur start signal SS, the value of the envelope data EDa varies as D1, D1+d, D1+2d, . . . , D1+(SDN−1)d, D2 (see dotted line of FIG. 5(*e*)). Herein, the above-mentioned number SDN is supplied from a readout control circuit 19, which will be described later.

Figure 6:
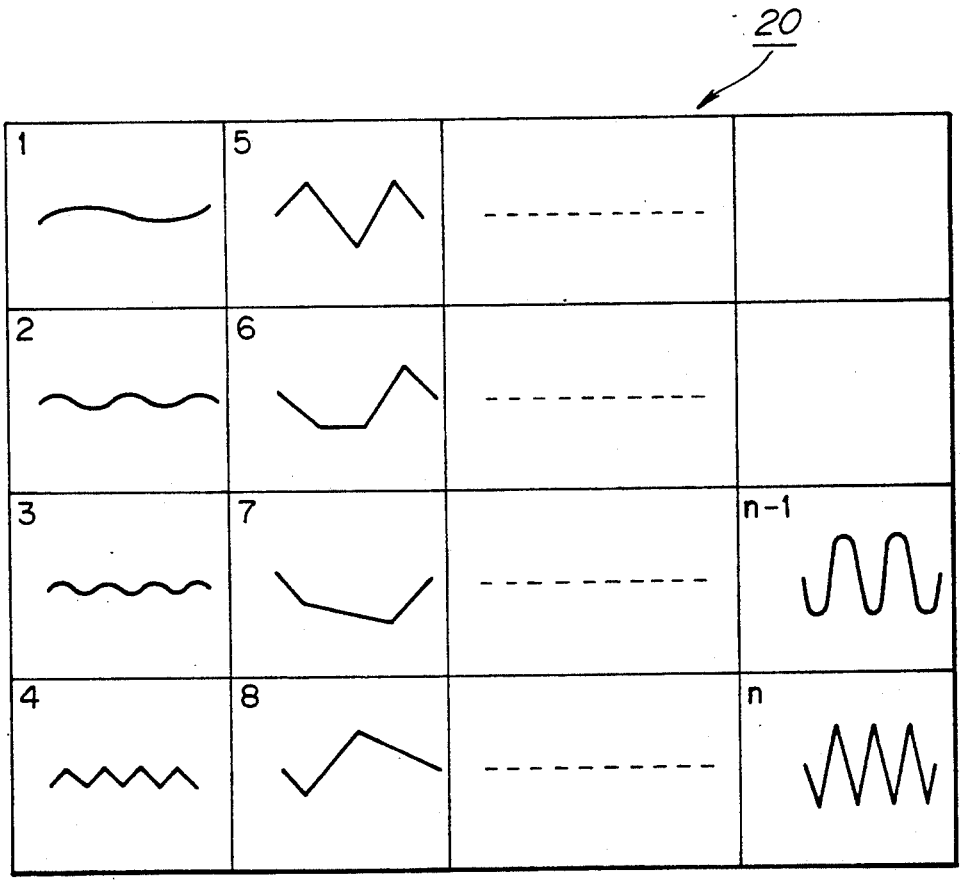
FIG. 6 shows stored contents of a slur envelope memory shown in FIG. 3.

Next, a slur envelope memory 20 stores n envelope waveforms (see FIG. 6) which are used at the slur timing. Thus, instead of directly using the dotted line portion of FIG. 5(*e*), the present electronic musical instrument can apply several kinds of envelope waveforms as shown in FIG. 6 to this dotted line portion. One of these envelope waveforms is selected depending on the color code NC and touch data TD. Each waveform is stored in the form of data indicative of the displacement from its zero-level. Therefore, the slur envelope waveform (see FIG. 5(*f*)) read from the slur envelope memory 20 is added to the dotted line portion of FIG. 5(*e*). Thus, as shown in FIG. 5(*g*), the envelope waveform at the slur timing can vary in accordance with the slur envelope waveform read from the slur envelope memory 20.

As described above, the readout control circuit 19 reads out the slur envelope waveform from the slur envelope memory 20, wherein it contains a waveform number table 22 (see FIG. 7) and a head address table 23 (see FIG. 8). The waveform number table 22 pre-stores the number of the slur envelope waveform which is selected by the tone color code NC and upper six bits (i.e., leftmost six bits) of the touch data TD. By supplying NC and upper six bits of TD, the number of the corresponding slur envelope waveform is read from this table 22. On the other hand, the head address table 23 stores the foregoing number SDN and the head address of the storage area of the memory 20 wherein each slur envelope waveform is stored. By supplying the envelope waveform number, the head address and SDN are read from this table 23.

The readout control circuit 19 normally outputs "0" signal. When the slur start signal SS is supplied, this readout control circuit 19 outputs the tone color code NC from the tone color detecting circuit 6 and the touch data TD from the initial-touch detecting circuit 4, both of which are then supplied to the waveform number table 22, from which the slur envelope waveform number is read out. The read slur envelope waveform number is supplied to the head address table 23, from which the head address and SDN are to be read out. Then, the read SDN is fed to the envelope data generating portion 18. Thereafter, based on the head address read from the table 23, the readout control circuit 19 sequentially reads the slur envelope data from the slur envelope memory 20, which are then sequentially supplied to an adder 21 by the timings of clock pulse Ce.

The adder 21 adds the envelope data EDa from the envelope data generating portion 18 and the output of the readout control circuit 19 together, so that its addition result is outputted as the envelope data ED. In other words, this adder 21 normally outputs the data EDa as the envelope data ED. But, while the slur start signal SS is generated, the adder 21 adds the data EDa and the slur envelope data from the readout control circuit 19 together (see FIGS. 5(*e*), 5(*f*)) to thereby output its addition result as the envelope data ED (see FIG. 5(*g*)).

The above-mentioned envelope generating circuit 12 prestores several kinds of envelope waveforms in the slur envelope memory 20. Then, based on the stored waveforms, the desirable variation is given to the envelope during the slur performance. Instead of storing these envelope waveforms, it is possible to provide plural operation formulae in advance. In this case, based on the tone color code NC, desirable one of these operation formulae is selected, by which the desirable envelope data is computed.

(3) SLUR EFFECTING CIRCUIT 9

Figure 9:
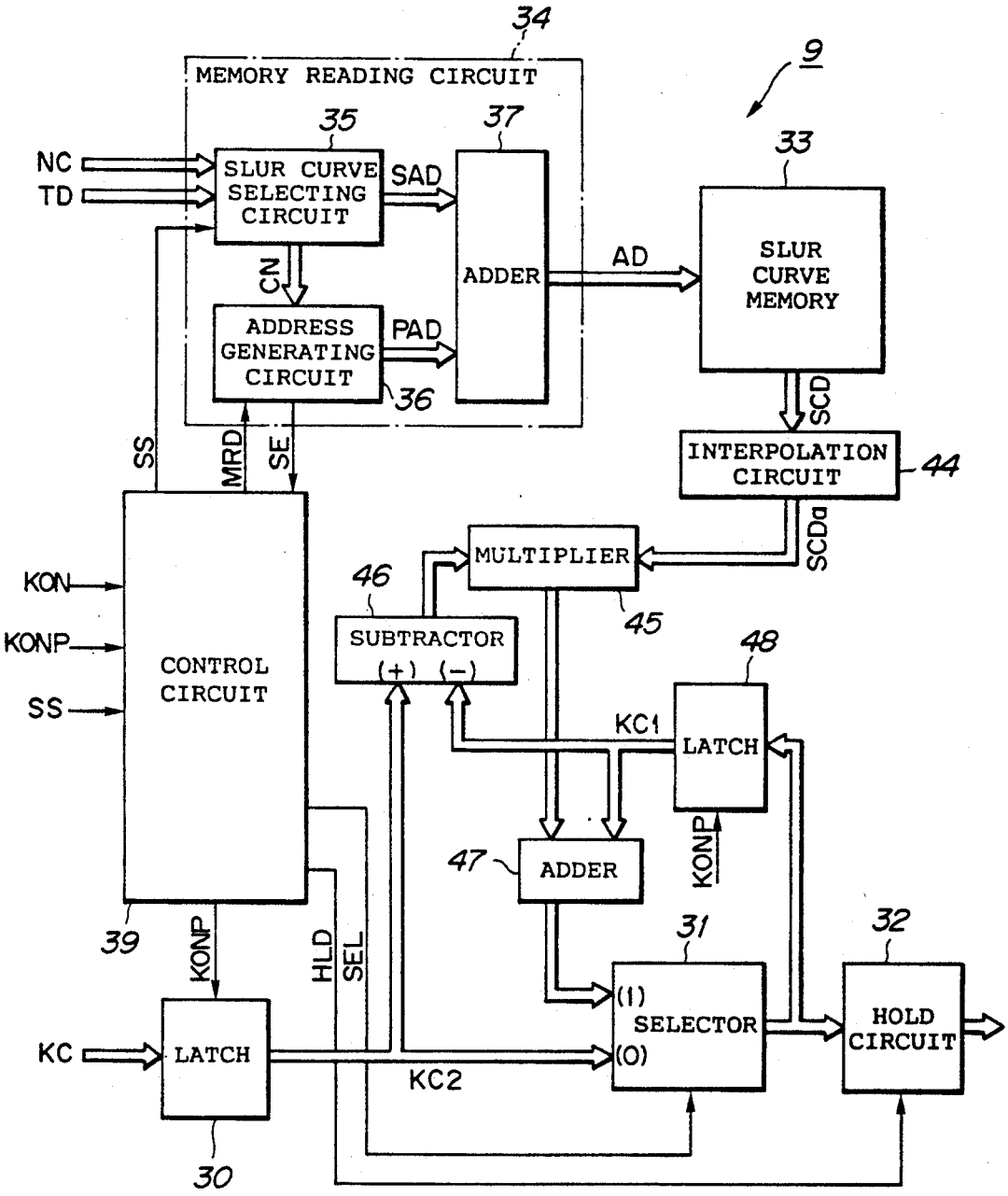
FIG. 9 is a block diagram showing a configuration of the slur effecting circuit shown in FIG. 1.

FIG. 9 is a block diagram showing the configuration of the slur effecting circuit 9. In the normal case of this slur effecting circuit 9, the key code KC from the key-depression detecting circuit 2 shown in FIG. 1 is latched by a latch 30 at once; then the latched key code KC is outputted to the tone generator 10 shown in FIG. 1 via a selector 31 and a hold circuit 32 which is at the through state. On the other hand, when the slur start signal SS is supplied to this circuit 9, a certain slur curve is read from a slur curve memory 33; the key code KC which varies in accordance with the read slur curve is generated; and then the generated key code KC is outputted via the hold circuit 32. Hereinafter, detailed description will be given with respect to this slur effecting circuit 9.

(a) Configuration of Slur Effecting Circuit 9

Figure 10:
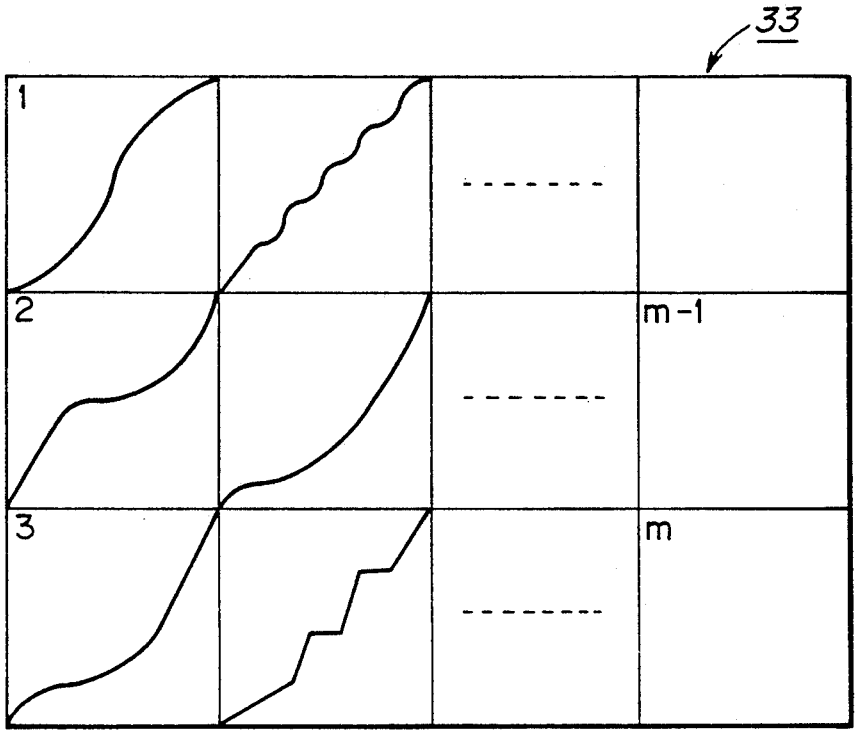
FIG. 10 shows stored contents of a slur curve memory shown in FIG. 9.
Figure 11A:
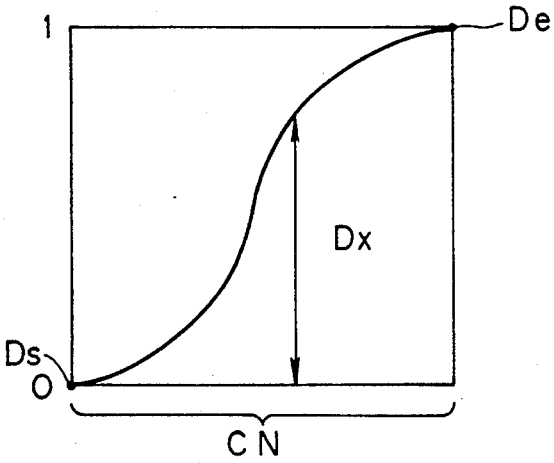
FIGS. 11A, 11B show examples of slur curves.

FIG. 10 is a diagram showing the above-mentioned slur curve memory 33, which stores m different slur curve data. Each slur curve data contains first data Ds at "0" and last data De at "1" as shown in FIG. 11A. In addition, its middle data Dx has the value of $0 \leqq Dx \leqq 1$. The number CN of data contained in each slur curve data differs by each slur curve. Then, each data in the slur curve data is read from Ds to De.

In FIG. 9, 34 designates a memory reading circuit which reads data from the slur curve memory. This memory reading circuit 34 consists of a slur curve selecting circuit 35, an address generating circuit 36 and an adder 37.

Figure 12:
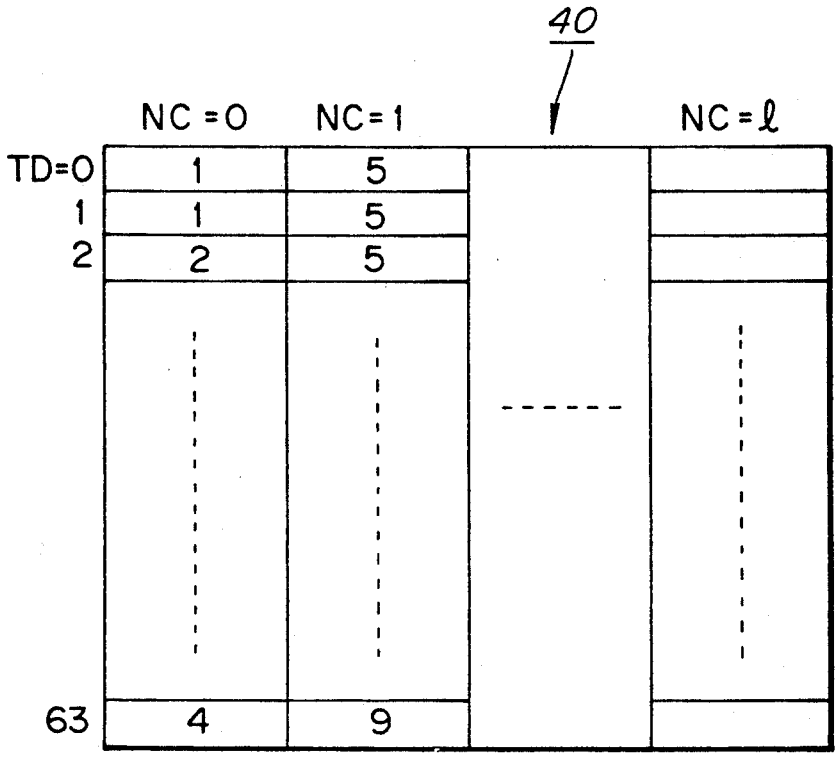
FIGS. 12, 13, respectively show the contents of a waveform number table and a head address table provided in the slur curve selecting circuit shown in FIG. 9.
Figure 13:
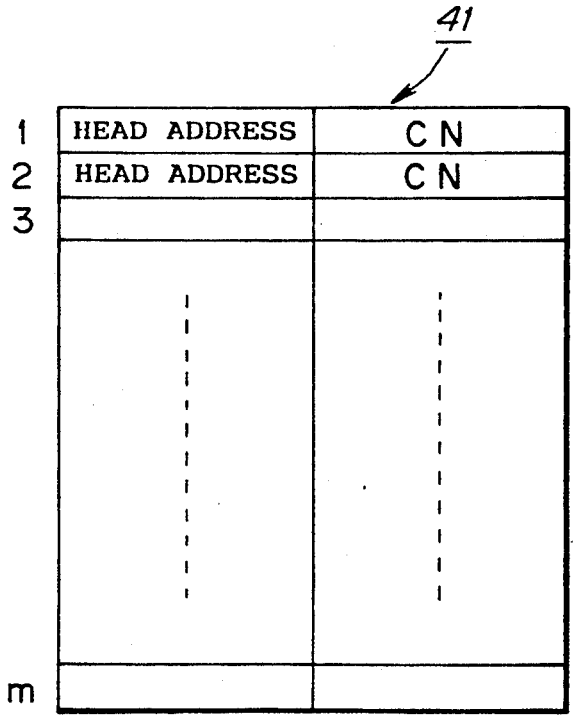

The slur curve selecting circuit 35 contains a waveform number table 40 (see FIG. 12) and a head address table 41 (see FIG. 13) therein. The waveform number table 40 pre-stores the slur curve number which is determined by the tone color code NC and upper six bits of the touch data TD. By supplying NC and upper six bits of TD as the address data, the corresponding slur curve number is read from the waveform number table 40. On the other hand, the head address table 41 stores the head address of the storage area of the memory 33 at which each slur curve is stored, and it also stores CN indicative of the number of data consisting each slur curve. By supplying the slur curve number as the address data, the corresponding head address and CN are read from the head address memory 41. When the slur start signal SS is supplied to the slur curve selecting circuit 35, the tone color code NC and touch data TD are supplied to the waveform number table 40, from which the slur curve number is to be read out. Then, based on the read slur curve number, the head address and CN are read from the head address table 41. The read head address is outputted to the adder 37 as address data SAD, while the data CN is outputted to the address generating circuit 36.

The address generating circuit 36 generates address data PAD whose value increases as 0, 1, 2, . . . Based on the address data PAD, each data consisting the slur curve corresponding to the slur curve number determined by the slur curve selecting circuit 35 is read from the slur curve memory 33. This address generating circuit 36 consists of an address counter, a gate circuit, a comparator circuit, etc. (not shown). At a leading edge timing of a memory read signal MRD (i.e., "1" signal) outputted from a control circuit 39, the address counter within the address generating circuit 36 is reset. Thereafter, this address counter counts up a slur clock Cs, which is outputted to the adder 37 as the address data PAD. When the count value of the address counter coincides with CN outputted from the slur curve selecting circuit 35, the address generating circuit 36 outputs a slur end signal SE to the control circuit 39. When the control circuit 39 receives this slur end signal SE, it turns the level of the memory read signal MRD to "0". Thus, the count operation of the address counter is terminated.

The adder 37 adds the head address SAD from the slur curve selecting circuit 35 and the address data PAD from the address generating circuit 36 together, and then its addition result is outputted to the slur curve memory 33 as the address data AD. Based on the address data AD, the data in the slur curve memory 33 are sequentially read out and then supplied to an interpolation circuit 44. This interpolation circuit 44 effects the linear interpolation on the data outputted from the slur curve memory 33. Then, the interpolated data are sequentially outputted to a multiplier 45. This multiplier 45 multiplies the output of the interpolation circuit 44 with an output of a subtractor 46 to thereby obtain its multiplication result, which is outputted to an adder 47. The adder 47 adds the output of the multiplier 45 with an output of a latch 48, and then its addition result is outputted to an input <1> of the selector 31. In addition, the latched key code KC is fed to another input <0> of the selector 31 from the latch 30. This selector 31 selects the output of the adder 47 when a select signal SEL from the control circuit 39 is at "1", while it selects the output of the latch 30 when SEL is at "0". Next, the hold circuit 32 is set in the through state when a hold signal HLD from the control circuit 39 is at "0", while it stores and holds its input data (i.e., the output of the selector 31) when HLD is at "1".

Figure 14:
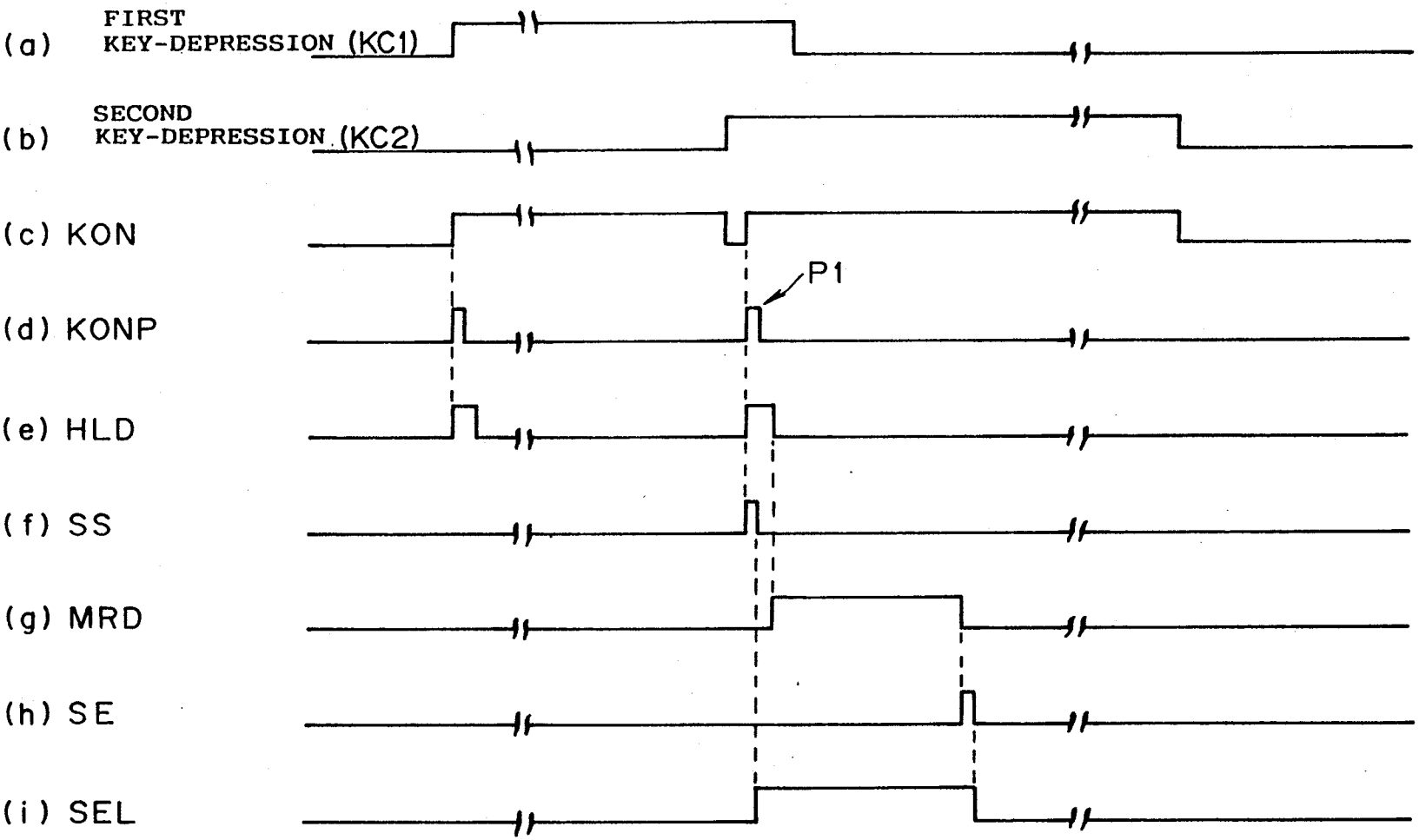
FIG. 14 is a timing chart for explaining operations of the slur effecting circuit shown in FIG. 9.

As described above, the control circuit 39 generates several control signals for controlling several parts of the slur effecting circuit 9. This control circuit 39 receives the key-on signal KON, key-on pulse KONP and slur start signal SS from the key-depression detecting circuit 2 to thereby generate the hold signal HLD, memory read signal MRD and select signal SEL. FIG. 14 shows the timings of these signals.

(b) Operation of Slur Effecting Circuit 9

Next, description will be given with respect to the operation of the slur effecting circuit 9.

(b-1) In case where the slur start signal SS is not supplied to the slur effecting circuit 9:

In this case, the control circuit 39 outputs the "0" signal to the selector 31 as the select signal SEL. Thus, the selector 31 selects the output of the latch 30. In such state, when the key-on pulse KONP is supplied to the control circuit 39 at the leading edge timing of the key-on signal KON, the control circuit 39 outputs this key-on pulse KONP to the latch 30 as it is. In addition, the control circuit 39 outputs the hold signal HLD (i.e., "1" signal) to the hold circuit 32. The pulse width of the hold signal HLD is about two times longer than that of the key-on pulse KONP. When the key-on pulse KONP is supplied, the latch 30 latches the key code KC, which is then supplied to the hold circuit 32 via the selector 31. When the hold signal HLD is reset to "0", the hold circuit 32 is set in the through state, so that the key code KC from the latch 30 is outputted to the tone generator 10 (see FIG. 1).

(b-2) In case where the slur start signal SS is supplied to the slur effecting circuit 9:

In this case, the operation will be described by referring to FIG. 14. Hereinafter, the key code outputted from the key-depression detecting circuit 2 based on the first key-depression will be designated by KC1, while another key code based on the second key-depression will be designated by KC2.

At first, the key-on pulse KONP (see P1 in FIG. 14(*d*)) based on the second key-depression is supplied to the control circuit 39. At the same time, the slur start signal SS (see FIG. 14(*f*)) is supplied to the control circuit 39. At this time, the control circuit 39 outputs the key-on pulse KONP to the latches 30, 48, while it outputs the hold signal HLD (see FIG. 14(*e*)) to the hold circuit 32. Due to the key-on pulse KONP, the latch 48 latches the first key code KC1, while another latch 30 latches the second key code KC2. Due to the hold signal HLD (at "1" level), the hold circuit 32 holds the first key code KC1.

At the trailing edge timing of the slur start signal SS, the control circuit 39 outputs the select signal (i.e., "1" signal) to the selector 31. Thereafter, the selector 31 selects the output of the adder 47. Then, the control circuit 39 resets the hold signal HLD to "0" level, and it also outputs the memory read signal MRD (i.e., "1" signal) (see FIG. 14 (*g*)) to the address generating circuit 36. When the hold signal HLD is reset to "0", the hold circuit 32 is set in the through state. Thereafter, the output of the adder 47 is fed to the tone generator 10 via the selector 31 and hold circuit 32. After the memory read signal MRD is supplied to the address generating circuit 36, the adder 37 sequentially outputs the address data AD, which are supplied to the slur curve memory 33. Thus, the slur curve memory 33 sequentially outputs slur curve data SCD corresponding to the touch data TD based on the tone color code NC and second key-depression. The slur curve data SCD are supplied to the interpolation circuit 44, and then interpolated slur curve data SCDa are sequentially fed to the multiplier 45.

The multiplier 45 multiplies the output of the subtractor 46, i.e., the value (KC2−KC1) by the interpolated slur curve data SCDa to thereby output its multiplication result to the adder 47. The adder 47 adds the output of the multiplier 45 and the first key code KC1 from the latch 48 together to thereby obtain its addition result KC1+(KC2−KC1)*SCDa. Herein, the data SCDa is 0<SCDa<1. Therefore, the following equality can be obtained.

$$KC1 \leqq KC1+(KC2-KC1)*SCDa \leqq KC2$$

Figure 11B:
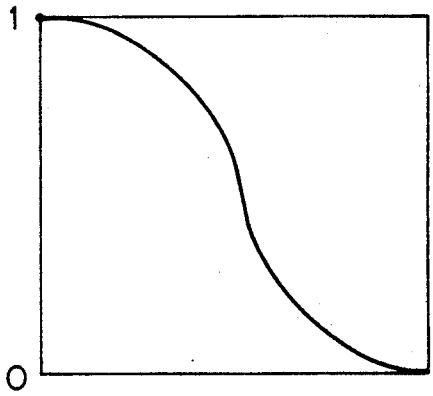

As a result, if the data SCDa varies in accordance with the waveform as shown in FIG. 11A in case of KC1<KC2, the output of the adder 47 varies in accordance with such waveform. On the other hand, in case of KC1>KC2, the output of the adder 47 varies in accordance with the inverted waveform of FIG. 11A, i.e., the waveform as shown in FIG. 11B. Then, the output of the adder 47 is supplied to the tone generator 10 via the selector 31 and hold circuit 32. Thus, the tone generator 10 forms the musical tone data GD whose pitch varies in accordance with the slur curve stored in the slur curve memory 33. The foregoing multiplier 11 (see FIG. 1) multiplies this musical tone data GD by the envelope data ED outputted from the envelope generating circuit 12, and then its multiplication result is converted into the analog signal by the D/A converter 13. Thus, the sound system 14 sounds the musical tone on which the slur is effected.

The above is the description of the operation of effecting the slur in the normal performance of the slur effecting circuit 9.

Figure 15:
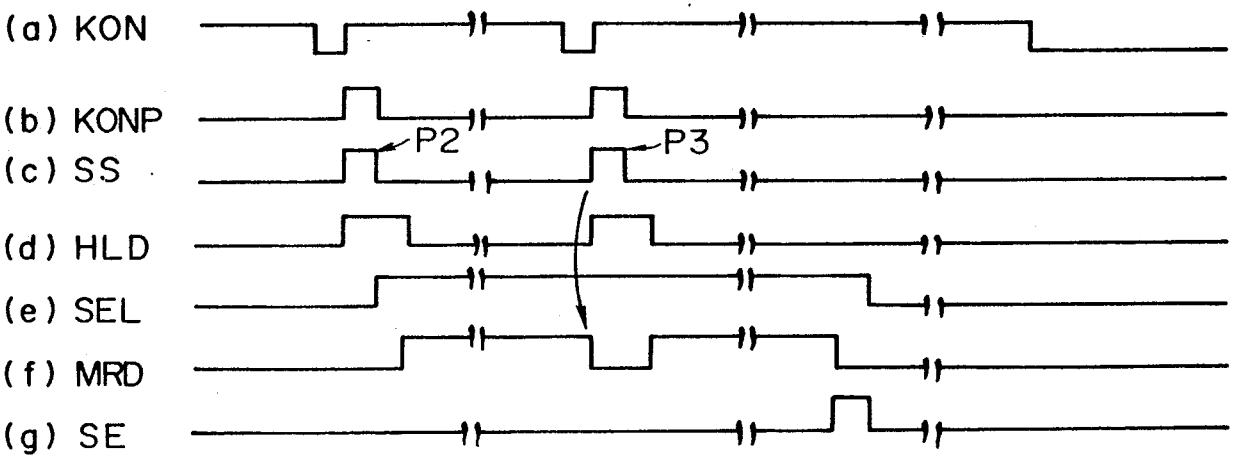
FIGS. 15 to 17 are timing charts for explaining operations of the slur effecting circuit in case of specific key operations.

(c) Operation of Slur Effecting Circuit 9 in case of the specific key-depression (c-1) In case where the performer carries out the slur operation again during the slur automatic performance:

FIG. 15 is a timing chart of several signals used in the slur effecting circuit 9 in this case. In FIG. 15(*c*), P2 designates the pulse corresponding to the first slur operation in the slur start signal SS. At the trailing edge of the hold signal HLD which rises up with this pulse P2, the memory read signal MRD rises up so that the slur automatic performance is made. When the performer carries out the slur operation again before the leading edge of the memory read signal (i.e., during the slur automatic performance), the slur start signal SS designated by P3 is supplied to the control circuit 39 of the slur effecting circuit 9. The control circuit 39 receives this slur start signal SS (i.e., pulse P3) to thereby carry out the foregoing processes. More specifically, the key-on pulse KONP is supplied to the latches 30, 48, and the hold signal HLD is supplied to the hold circuit 32. Then, the memory read signal MRD is reset to "0", which is the specific process different from the normal slur processes described before. Thereafter, as described before, the control circuit 39 sets the select signal SEL to "1" (however, this signal has been already set to "1") and then also sets the memory read signal MRD to "1". Thereafter, the foregoing reading operation is carried out on the slur curve memory 33. When the address generating circuit 36 outputs the slur end signal SE to the control circuit 39, the slur process is terminated.

Figure 16:
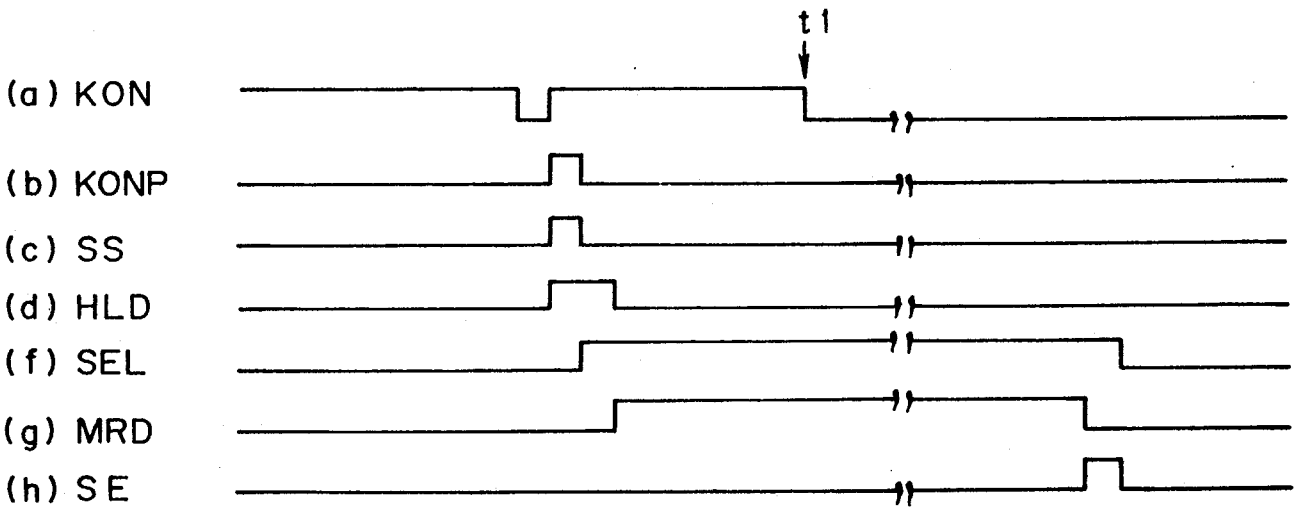

(c-2) In case where the second key-depression is released during the slur automatic performance:

FIG. 16 is a timing chart of this case. If the second key-depression is released at time t1 shown in FIG. 16(*a*), some signals are not varied as shown in FIGS. 16(*f*) to 16(*h*). In this case, the key-on signal KON falls down to "0" so that the envelope will be attenuated. In contrast, the slur performance is continued with respect to the tone pitch.

Figure 17:
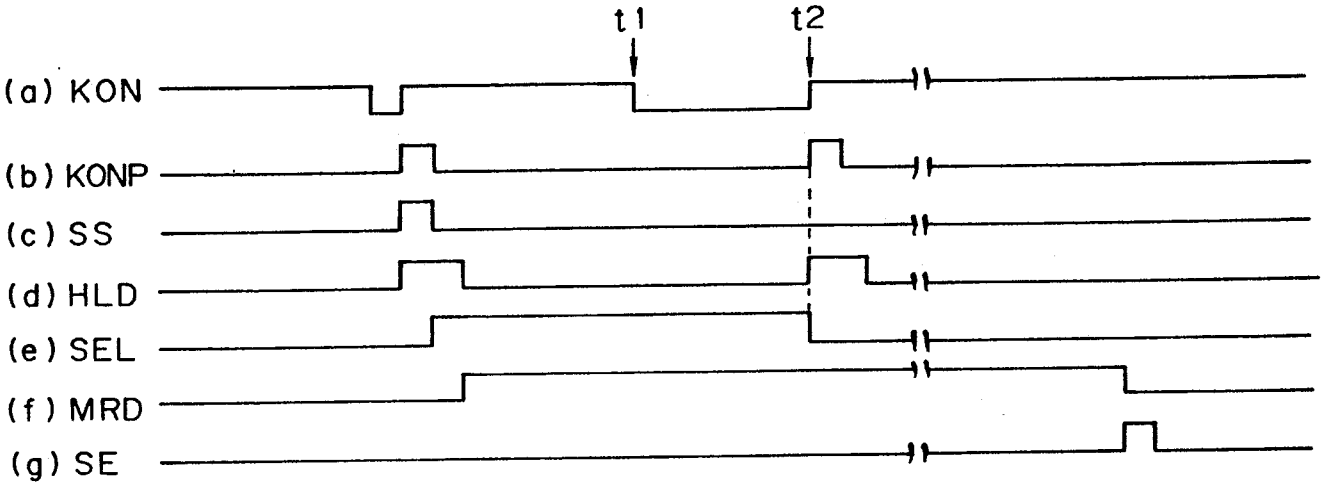

(c-3) In case where the third key-depression is made just after the second key-depression is released during the slur automatic performance:

FIG. 17 is a timing chart of this case. When the third key-depression is made at time t2 before the slur end signal SE is generated after the second key-depression is released at time t1, the key-on pulse KONP is supplied to the control circuit 39. At the leading edge timing t2 of KONP, the select signal SEL is reset to "0" (see FIG. 17(*e*)) so that the selecting state of the selector 31 is changed over. In this case, however, the slur start signal SS is not generated, so that the normal musical tone generation (which is not concerned with the slur performance) is made thereafter. Incidentally, it is apparent from FIGS. 17(*f*), 17(*g*), after the selector 31 is changed over, the memory read signal MRD is continuously outputted to the address generating circuit 36. Therefore, the count operation of the address counter in the address generating circuit 36 will be continued until the slur end signal SE is generated.

(d) Modified Example of Slur Effecting Circuit 9

Figure 19:
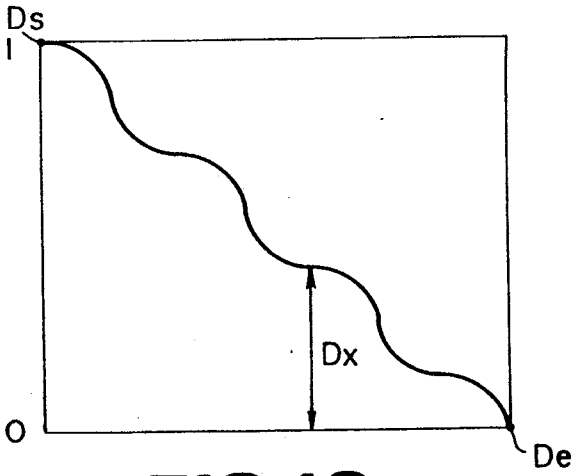
FIG. 19 shows an example of a slur curve stored in a slur curve memory shown in FIG. 18.
Figure 18:
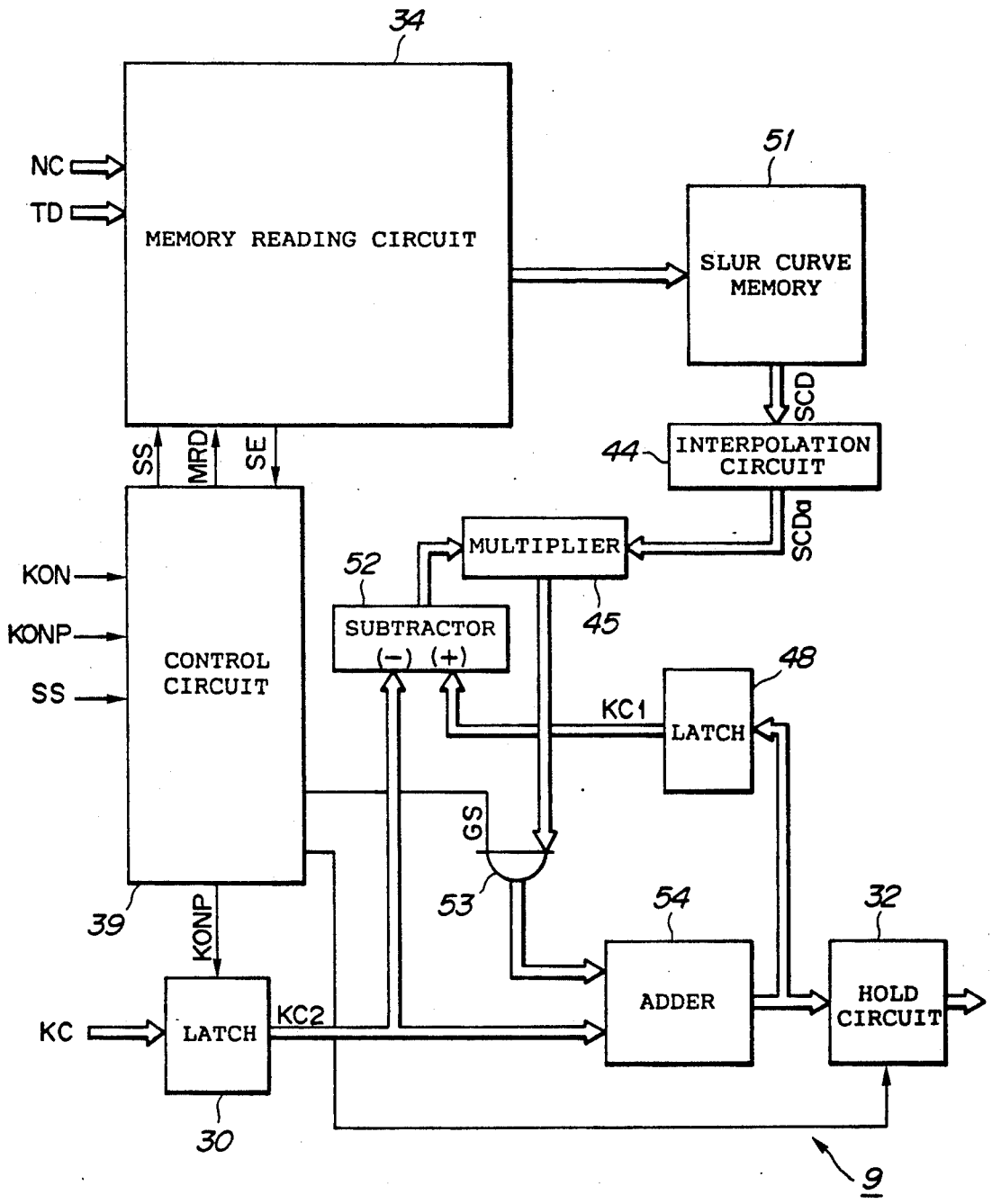
FIG. 18 is a block diagram showing a modified example of the slur effecting circuit.

Next, description will be given with respect to a modified example of the slur effecting circuit 9. FIG. 18 is a block diagram showing this modified example. In FIG. 18, the parts identical to those of FIG. 9 are designated by the same numerals, hence, description thereof will be omitted. The main difference between the circuits shown in FIGS. 9 and 18 is the data stored in slur curve memory 51. More specifically, the data in the foregoing slur curve memory 33 varies from "0" to "1" as shown in FIG. 11A, while the data in this slur curve memory 51 varies from "1" to "0" as shown in FIG. 19. In this case, the data of $Ds=1$ is read from the slur curve memory 51. Thereafter, the data of $0 \leqq Dx \leqq 1$ are sequentially read out. Finally, the data of $De=0$ is read out.

Another difference between the circuits shown in FIGS. 9 and 18 is the process of the data read from the interpolation circuit 44. In FIG. 18, a subtractor 52 subtracts the key code KC2 of the latch 30 from the key code KC1 of the latch 48. Then, the multiplier 45 multiplies the subtraction result by the slur curve data SCDa from the interpolation circuit 44. This multiplication result, i.e., $(KC1-KC2)*SCDa$ is supplied to an adder 54 via a gate circuit 53. Herein, a gate control signal GS for controlling the gate circuit 53 rises up at "1" at the leading edge timing of the foregoing select signal SEL. While this gate control signal GS is at "1", the gate circuit 53 is set in the open state. The adder 54 executes the arithmetic operation of $(KC1-KC2)*SCDa+KC2$. Then, the operation result of the adder 54 is outputted as a key code KCS via the hold circuit 32.

In this modified example of the slur effecting circuit 9, in case of $KC1>KC2$, the electronic musical instrument carries out the slur automatic performance in which the tone pitch varies in accordance with the waveform in the slur curve memory 51 (see FIG. 19). In case of $KC1<KC2$, the slur automatic performance is carried out such that the tone pitch varies in accordance with the inverted waveform of FIG. 19.

In the present embodiment, the tone pitches of the slurred notes are varied in accordance with the data in the slur curve memory 33 or 51. Instead, it is possible to select a desirable one of the arithmetic operations based on the tone color code NC so that the tone pitch is varied by the selected arithmetic operation. Similarly, instead of the envelope control being based on the waveform in the slur envelope memory 20, it is possible to select desirable one of plural arithmetic operations so that the envelope control is made based on the selected arithmetic operation.

In addition, the present embodiment selects the envelope waveform in the slur envelope memory 20 based on the touch data TD indicative of the initial touch intensity. Instead, it is possible to select the envelope waveform based on the difference in the touch data TD between the first slur note and last slur note. Further, it is also possible to select the envelope waveform based on the key-off velocity (i.e., key releasing speed) of the first slur note. Furthermore, it is also possible to select the envelope waveform based on the maximum level of the after-touch intensity of the first slur note, after-touch intensity level of the first slur note at the key-on timing of the last slur note, or after-touch intensity level of the first slur note at the key-off timing of the first slur note. In addition, it is possible to select the envelope waveform based on the result of measuring the continuing time of the actually generated tone with respect to the note length of the first slur note. Further, it is possible to provide slur envelope curve selecting switches by which the performer can select a desirable one of the slur envelope curves. Incidentally, the above-mentioned modifications concerning the selection of the slur envelope waveform can be also applied to the waveform selection of the slur curve memory 33 or 51.

[C] MODIFIED EXAMPLE

Figure 20:
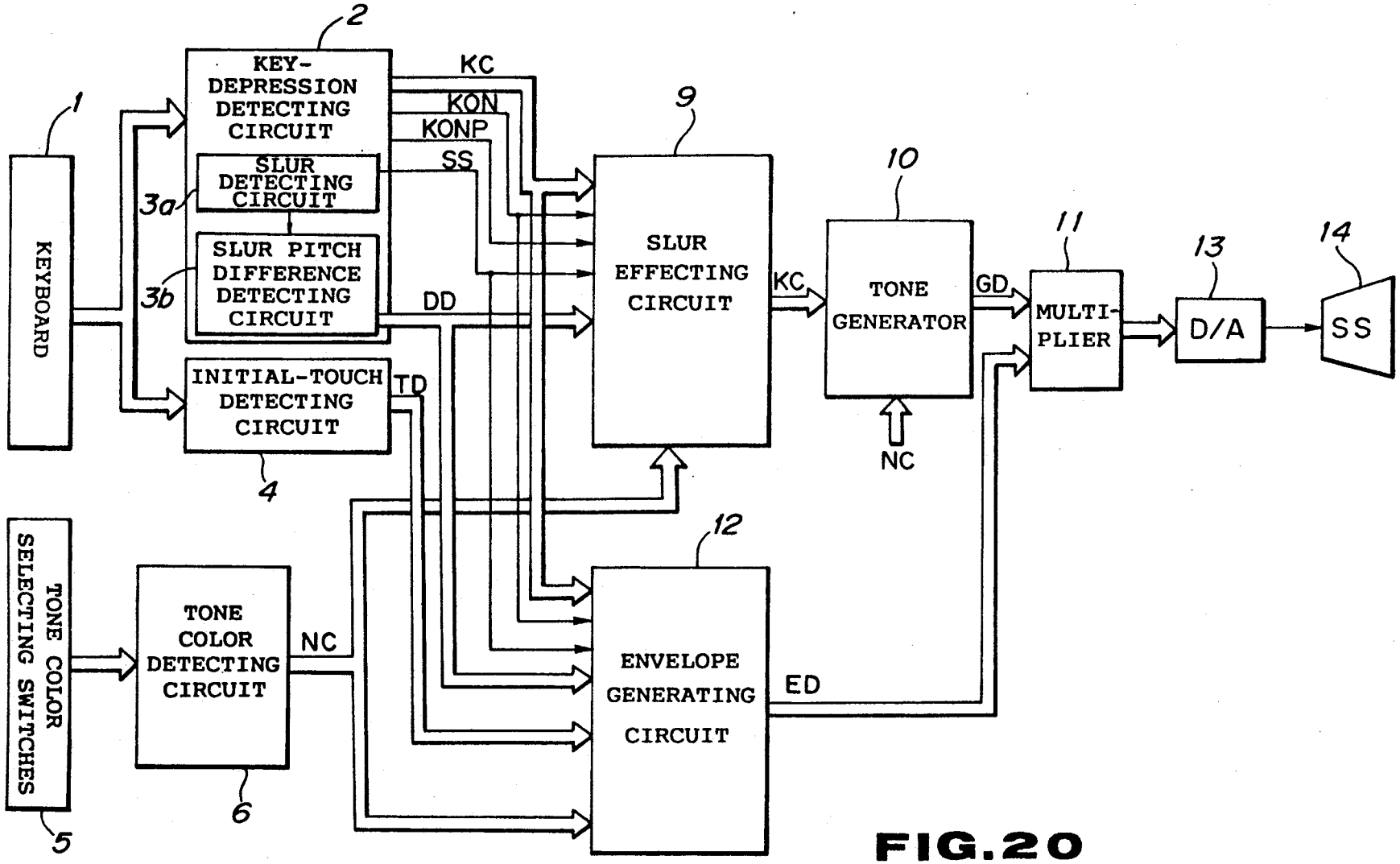
FIG. 20 is a block diagram showing a modified example of the electronic musical instrument shown in FIG. 1.
Figure 21:
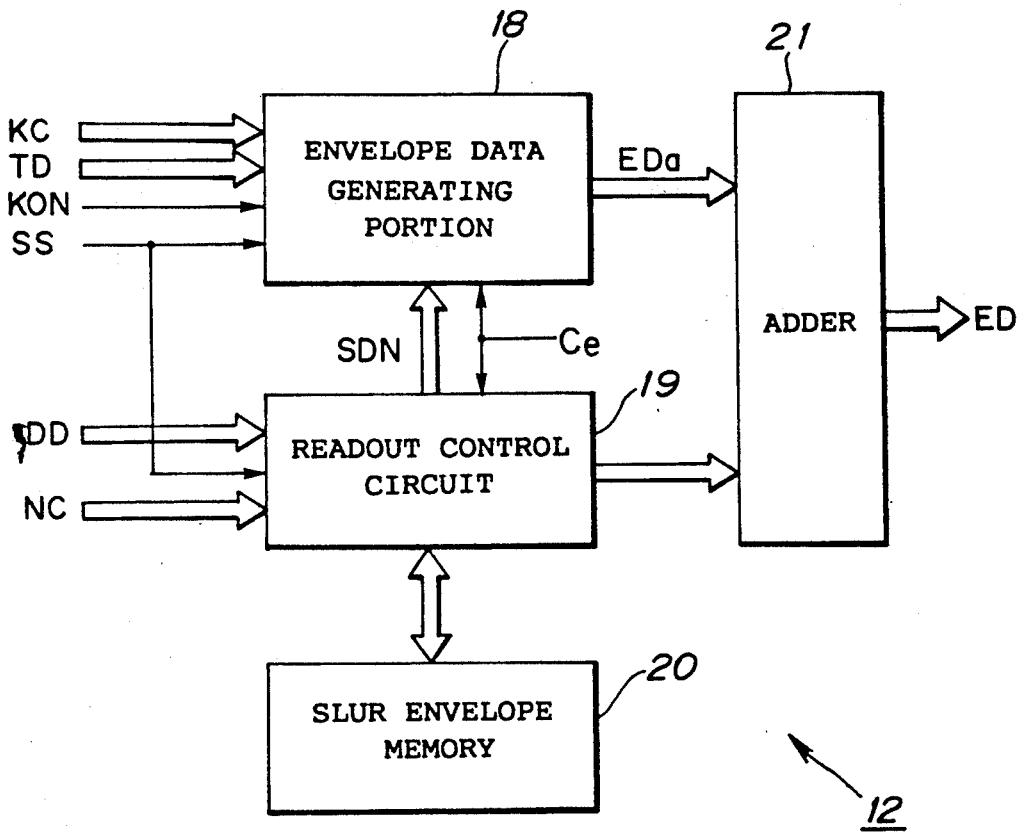
FIG. 21 is a block diagram showing the envelope generating circuit shown in FIG. 20.

(1) Modified Example of FIGS. 20 & 21

Next, description will be given with respect to a modified example of the electronic musical instrument by referring to FIGS. 20, 21. In FIGS. 20, 21, the parts identical to those in FIG. 1 are designated by the same numerals, hence, description thereof will be omitted except some different points. The key-depression detecting circuit 2 shown in FIG. 20 is characterized by providing a slur detecting circuit 3*a* and a slur pitch difference detecting circuit 3*b* therein. The slur detecting circuit 3*a* corresponds to the foregoing slur detecting circuit 3 shown in FIG. 1, while the slur pitch difference detecting circuit 3*b* is newly provided in order to detect the pitch difference between the first slur note and last slur note. This circuit 3*b* generate a pitch difference data DD corresponding to the pitch difference between the key code of the first slur note and another key code of the last slur note. This pitch difference data DD is supplied to both the slur effecting circuit 9 and envelope generating circuit 12.

In FIG. 20, the touch data TD outputted from the initial-touch detecting circuit 4 is not supplied to the slur effecting circuit 9. Instead of this touch data TD, the above-mentioned pitch difference data DD is used in the slur effecting circuit 9. Therefore, the slur curve selecting circuit 35 (see FIG. 9) reads out and then outputs the foregoing data SAD and CN based on the tone color code NC and pitch difference data DD.

Similarly, instead of the touch data TD, the pitch difference data DD is supplied to the readout control circuit 19 shown in FIG. 21. Based on the tone color code NC and upper six bits of the pitch difference data DD, the slur envelope waveform number is read from the waveform number table 22 in the readout control circuit 19.

(2) TONE GENERATOR 10

(a) Configuration of Tone Generator 10

Figure 22:
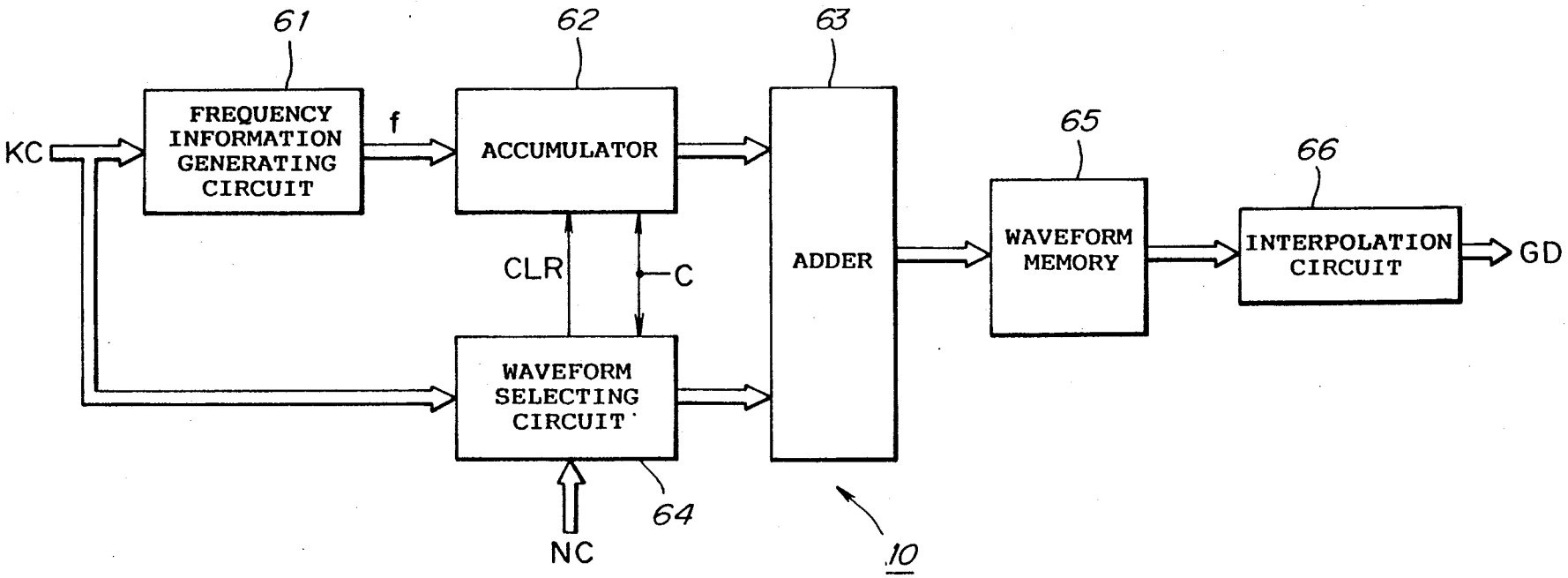
FIG. 22 is a block diagram showing the detailed configuration of the tone generator shown in FIG. 20.

Next, detailed description will be given with respect to the tone generator 10 by referring to FIG. 22. In FIG. 22, 61 designates a frequency information generating circuit which generates frequency information (in other words, f-number) corresponding to the key code KC outputted from the slur effecting circuit 9. This f-number is supplied to an accumulator 62. Herein, the f-number can be identified as a data value proportional to the fundamental frequency of the tone pitch of the musical tone signal indicated by the key code KC. The accumulator 62 repeatedly accumulates the f-number by the timing of clock C, and then its accumulation result is outputted to an adder 63. When the accumulator 62 receives a clear signal CLR from a waveform selecting circuit 64, the accumulated value of the accumulator 62 is cleared. Thereafter, the accumulator 62 accumulates the f-numbers again. The adder 63 adds the outputs of the accumulator 62 and waveform selecting circuit 64 together to thereby obtain its addition result, which is supplied to a waveform memory 65 as address data.

The waveform memory 65 pre-stores digital data concerning n musical tone waveforms. Each musical tone waveform consists of its attack portion and repeating portion. When forming the musical tone signal, the attack portion is read out and then the repeating portion is read out. Thereafter, the waveform data read from the waveform memory 65 is supplied to an interpolation circuit 66 wherein the waveform data is subject to the linear interpolation. Then, the interpolated data is outputted to the multiplier 11 (see FIG. 20) as the musical tone data GD.

The waveform selecting circuit 64 selects one of n musical tone waveforms stored in the waveform memory 65. This waveform selecting circuit 64 is provided with the waveform number table and head address table therein. When the tone color code NC and key code KC are supplied to the waveform number table as the addresses, the corresponding waveform number (i.e., 1 to n) is read out from it. In response to the read waveform number which is supplied to the head address table, the following four data are read out:

(i) head address SAD1 of the storage area in the waveform memory 65 at which the attack portion of the musical tone waveform corresponding to the read waveform number is stored;

(ii) data KOD-1 indicative of the number of data concerning the attack portion;

(iii) head address SAD2 of the storage area in the waveform memory 65 at which the repeating portion of the musical tone waveform corresponding to the read waveform number is stored; and (iv) KOD-2 indicative of the number of data concerning the repeating portion.

(b) Operation of Tone Generator 10

Next, description will be given with respect to the operation of the tone generator 10. When the slur effecting circuit 9 outputs the key code KC, the frequency information generating circuit 61 generates the f-number corresponding to the key code KC, which is then outputted to the accumulator 62. When the key code KC is supplied to the waveform selecting circuit 64, the waveform selecting circuit 64 supplies the key code KC and tone color code NC to the waveform number table, from which the waveform number is read out. Then, the read waveform number (e.g., number "15") is supplied to the head address table, from which several data are read out as described above. Next, the clear signal CLR is outputted to the accumulator 62, and the head address SAD1 is outputted to the adder 63. Thereafter, the clock pulse C is counted up.

At the receipt of the clear signal CLR, the accumulator 62 is cleared. Thereafter, the accumulator 62 accumulates the f-number by the timing of clock pulse C. The adder 63 adds the output of the accumulator 62 and the head address SAD1 from the waveform selecting circuit 64 together, so that its addition result is outputted to the waveform memory 65. Thus, the data of the attack portion of the musical tone waveform corresponding to the waveform number "15" are sequentially read from the waveform memory 65, which are then outputted as the musical tone data GD via the interpolation circuit 66.

Next, when the number of data read from the waveform memory 65 reaches KOD-1, the waveform selecting circuit 64 outputs the clear signal CLR to the accumulator 62 again. At the same time, the waveform selecting circuit 64 outputs the head address SAD2 to the adder 63. Thereafter, the clock pulse C is counted up. Thus, the accumulator 62 is cleared. Thereafter, the accumulator 62 accumulates the f-number again. Then, the adder 63 adds the accumulation result and the head address SAD2 together, so that its addition result in outputted to the waveform memory 65. Thus, the data of the repeating portion of the musical tone waveform corresponding to the waveform number "15" are sequentially read from the waveform memory 65.

Next, when the number of the data read from the waveform memory 65 reaches KOD-2, the waveform selecting circuit 64 outputs the clear signal CLR to the accumulator 62 again. At the same time, the waveform selecting circuit 64 outputs the head address SAD2 to the adder 63. Thereafter, the clock pulse C is counted up. Thus, the data of the repeating portion of the musical tone waveform corresponding to the waveform number "15" are sequentially read from the waveform memory 65 again. Thereafter, the same operation of reading out the data of the repeating portion is repeated.

Next, when the key code KC varies, the frequency information generating circuit 61 generates the f-number corresponding to the varied key code, which is then outputted to the accumulator 62. The waveform selecting circuit 64 supplies the key code KC and the tone color code NC from the foregoing tone color detecting circuit 6 to the waveform number table, from which the corresponding waveform number is read out. The read waveform number is supplied to the head address table in order to read out several data. Then, the waveform selecting circuit 64 outputs the clear signal CLR to the accumulator 62 and also outputs the head address SAD1 to the adder 63. Thereafter, the waveform selecting circuit 64 starts to count up the clock pulse C. Thus, if the current waveform number is "16", the musical tone data corresponding to the musical tone waveform of number "16" are sequentially read from the waveform memory 65.

As described above, every time the key code KC or tone color code NC varies, the musical tone waveform corresponding to the varied KC or NC is read from the waveform memory 65. Then, the read musical tone waveform is outputted via the interpolation circuit 66. Incidentally, in case of the key-off event, the key code KC is not varied, so that the tone generator 10 does not alter its operation. In this case, the envelope data ED gradually decreases, so that finally the generation of the musical tone is terminated.

In the above-mentioned tone generator 10, the waveform to be read is varied when the key code KC is varied. In this case, by varying the waveform when the accumulator 62 is cleared after the key code KC is varied, it is possible to avoid the generation of the noise which occurs due to the change-over of the waveform. In addition, by setting each waveform in the waveform memory 65 to have the same number of data therein, it is possible to change-over the waveform at an arbitrary timing without sending the clear signal to the accumulator 62.

In the present embodiment, the musical tone signal is formed in accordance with the data in the waveform memory 65. On the other hand, the present embodiment can be applied to the frequency-modulation-type (i.e., FM-type) or filter-type electronic musical instrument. The present embodiment is applied to the slur effect, however, it can be also applied to the pitch bend effect. The present embodiment selects the waveform in the waveform memory 65 in response to the key code KC. However, in case of the filter-type electronic musical instrument, the filter characteristic is changed in response to the key code KC. On the other hand, in case of the FM-type electronic musical instrument, the parameters of the modulation are changed in response to the key code KC. Further, instead of effecting the slur by varying the key code KC, it is possible to effect the slur by varying the f-number.

Above is the description of the preferred embodiment of this invention. This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument, comprising:

(a) generating means for generating performance information each one regarding a different designated note of a performance;

(b) slur detecting means for detecting a slur performance based on said performance information for two notes sequentially generated by the generation means;

(c) slur curve selecting means for selecting one of preset slur transition functions selected by said slur curve selecting means when said slur performance is detected by said slur detecting means; and (d) varying means for sequentially varying musical tone states from a first note to subsequent notes in slurred notes in accordance with the slur transition function selected by said slur curve selecting means when said slur performance is detected by said slur detecting means.

2. An electronic musical instrument as set out in claim 1, wherein said slur curve selecting means selects said slur transition function based on a musical factor, wherein said musical factor designates one or more elements or settings of a musical instrument to be performed.

3. An electronic musical instrument as set out in claim 1, further comprising memory means for storing data representative of said slur transition functions.

4. An electronic musical instrument according to claim 1 wherein said performance information includes key-on information and key-off information, and said slur detecting means detects a slur performance when the key-on information of a first note is generated before the key-off information of a last note is generated.

5. An electronic musical instrument, comprising:

(a) generating means for generating performance information each one regarding a different designated note of a performance;

(b) slur detecting means for detecting a slur performance based on said performance information for two sequentially designated notes;

(c) tone color designating means for designating a tone color;

(d) slur curve selecting means for selecting one of preset slur transition functions in response to said tone color designated by said tone color designating means; and (e) varying means for sequentially varying musical tone states from a first note to a last note in slurred notes in accordance with the slur transition function selected by said slur curve selecting means when said slur performance is detected by said slur detecting means.

6. An electronic musical instrument comprising:

(a) generating means for generating performance information each regarding a different note of a performance;

(b) slur detecting means for detecting a slur performance based on at least two sequential notes defined by said performance information;

(c) memory means for storing data which varies in accordance with a predetermined curve; and (d) varying means for sequentially varying tone pitches from a first note to a last note in slurred notes in accordance with the curve indicated by said data which are sequentially read from said memory means when said slur performance is detected by said slur detecting means.

7. An electronic musical instrument, comprising:

(a) a keyboard;

(b) slur detecting means for detecting a slur performance when said slur performance is carried out by sequential key depression of keys on said keyboard;

(c) detecting means for detecting a key-depression intensity of a depressed key in said keyboard;

(d) slur curve selecting means for selecting one of preset lines or curves in response to the key-depression intensity detected by said detecting means; and (e) varying means for sequentially varying musical tone states from a first note to a last note in slurred notes in accordance with the line or curve selected by said slur curve selecting means when said slur detecting means detects said slur performance.

8. An electronic musical instrument, comprising:

(a) generating means for generating performance information each one regarding a different note of a performance;

(b) slur detecting means for detecting a slur performance based on at least two sequential notes defined by said performance information;

(c) pitch difference detecting means for detecting a pitch difference between a first note and a subsequent note in slurred notes when said slur detecting means detects said slur performance;

(d) slur curve selecting means for selecting one of preset slur functions in response to the pitch difference detected by said pitch difference detecting means; and (e) varying means for sequentially varying musical tone states from the first note to the subsequent note in the slurred notes in accordance with the slur function selected by said slur curve selecting means when said slur detecting means detects said slur performance.

9. An electronic musical instrument comprising:

(a) generating means for generating performance information each one regarding a different note of a performance;

(b) slur detecting means for detecting a slur performance based on at least two sequential notes defined by said performance information;

(c) pitch difference detecting means for detecting a pitch difference between a first note and a subsequent note in slurred notes when said slur detecting means detects said slur performance;

(d) memory means for storing plural sets of data indicating a plurality of slur transition lines or curves; and (e) varying means for selecting and reading out selected of said data from said memory means indicative of the slur transition line or curve corresponding to said pitch difference detecting means when said slur detecting means detects said slur performance, so that said varying means sequentially varies musical tone states from the first note to the subsequent note in the slurred notes in accordance with the slur transition line or curve corresponding to said selected and read data.

10. An electronic musical instrument, comprising:

(a) generating means for generating performance information each one regarding a different note of a performance;

(b) slur detecting means for detecting a slur performance based on at least two sequential notes defined by said performance information;

(c) slur curve selecting means for selecting one of preset slur transition lines or curves in response to a predetermined musical factor;

(d) pitch control means for controlling pitches of slurred notes such that said pitches are smoothly varied from said first note to said subsequent note in the slurred notes when said slur detecting means detects said slur performance; and (e) tone volume control means for sequentially varying tone volumes from said first note to said subsequent note in the slurred notes in accordance with the slur transition line or curve selected by said slur curve selecting means when said slur detecting means detects said slur performance.

11. An electronic musical instrument for generating a musical tone with a slur performance, comprising:

(a) generating means for generating performance information regarding different notes of a performance;

(b) slur detection means for detecting a slur performance based on the performance information for at least two notes sequentially generated by the generating means;

(c) providing means for providing pitch varying information, which designates sequentially varying tone pitches of musical tones from a first note to at least one subsequent note in slurred notes, when the slur performance is detected by the slur detection means;

(d) waveform memory means for storing a plurality of musical tone waveforms which are different from each other;

(e) selecting means for selecting a waveform corresponding to a current tone pitch between the first note and the subsequent note among the plurality of waveforms in accordance with the pitch varying information; and (f) musical tone generating means for generating a musical tone which has selected waveforms respectively corresponding to current tone pitches from the first note to the subsequent note, when the slur performance is detected by the slur detecting means, whereby the tone color of the musical tone is changed during the slur performance.

* * * * *